United States Patent [19]

Iwata et al.

[11] Patent Number: 4,710,106

[45] Date of Patent: Dec. 1, 1987

[54] VOLUME CONTROLLING DEVICE FOR VARIABLE VOLUME PUMP

[75] Inventors: Hiroshi Iwata; Masatoshi Kuroyanagi, both of Kariya; Masahiko Suzuki, Hoi; Koichi Moriguchi, Nagoya; Yasuhiro Horiuchi, Hoi; Kanehito Nakamura, Oubu, all of Japan

[73] Assignee: Nippondenso Co., Ltd., Kariya, Japan

[21] Appl. No.: 801,309

[22] Filed: Nov. 25, 1985

[30] Foreign Application Priority Data

Nov. 26, 1984 [JP] Japan ..... 59-249896
Nov. 5, 1985 [JP] Japan ..... 60-247687

[51] Int. Cl.[4] ..... F04B 49/00; F04B 1/06

[52] U.S. Cl. ..... 417/213; 417/218; 417/219; 60/450; 60/459

[58] Field of Search ..... 417/212, 213, 216, 218–222; 60/433, 459, 450

[56] References Cited

U.S. PATENT DOCUMENTS

| | | | |
|---|---|---|---|
| 3,246,471 | 4/1966 | Goodale | 60/450 X |
| 3,296,797 | 1/1967 | Tlusty | 417/218 X |
| 4,011,721 | 3/1977 | Yip | 60/450 X |
| 4,067,664 | 1/1978 | Robeller | 417/218 |
| 4,293,284 | 10/1981 | Carlson et al. | 417/218 |

FOREIGN PATENT DOCUMENTS

| | | | |
|---|---|---|---|
| 44518 | 1/1982 | European Pat. Off. | 417/212 |
| 2232018 | 1/1974 | Fed. Rep. of Germany | 60/450 |
| 3129440 | 2/1983 | Fed. Rep. of Germany | 417/218 |
| 102587 | 6/1982 | Japan | 417/218 |
| 131888 | 8/1982 | Japan | 417/218 |
| 131891 | 8/1982 | Japan | 417/220 |
| 58-110881 | 7/1983 | Japan | 417/216 |
| 222990 | 12/1983 | Japan | 417/213 |
| 222988 | 12/1983 | Japan | 417/213 |
| 222989 | 12/1983 | Japan | 417/213 |
| 592817 | 11/1977 | Switzerland | 417/218 |

*Primary Examiner*—William L. Freeh
*Assistant Examiner*—Paul F. Neils
*Attorney, Agent, or Firm*—Cushman, Darby & Cushman

[57] ABSTRACT

The device of this invention has a variable capacity pump, a channel through which the discharged fluid from the pump passes toward an actuator, a variable choke located in the channel and pressure detecting means which detects the pressure difference on opposite sides of the variable choke. The pump varies its volume in relation with the pressure difference detected by the pressure detecting means. The opening area of the channel is varied by the variable choke in relation with the pressure of the fluid being supplied to the actuator, namely the pressure of the fluid flowing downstream of the variable choke. The device of this invention may also have an auxiliary variable choke located in the channel. The auxiliary variable choke can control the amount of fluid being supplied to the actuator in response to the operating condition of the actuator.

10 Claims, 22 Drawing Figures

VOLUME CONTROLLING DEVICE FOR VARIABLE VOLUME PUMP

BACKGROUND OF THE INVENTION

1. Field of the Invention

This invention relates to a volume controlling device for a variable volume pump, especially this invention has a special usage for using as an automotive power steering device. The amount of fluid discharged from the present pump changes as the fluid needs of the power steering device change.

2. Description of the Prior Art

Many kinds of volume controlling devices have been proposed, especially which vary pump volume while maintaining good pump efficiency. For example, the device described in Japanese patent KOKAI (laid-open publication), 58-110881 maintains the product of the output pressure and amount of fluid discharged constant while the device varies the pump volume in order to maintain pumping efficiency.

This conventional device, however, needs a special choke located in a special controlling channel. This controlling channel is different from the main channel through which the discharged fluid from the pump passes. Thus, the special choke needs the special controlling channel. Furthermore, the special choke needs working fluid for signaling. Since the special working fluid for the special choke should increase in relation with the amount of the discharged fluid, the special choke has the problem for wasting pump energy.

SUMMARY OF THE INVENTION

This invention has the object of controlling the amount of the discharged fluid without any special channel for the choke. This device can control the amount of the discharged fluid using the actual amount thereof as the signal for controlling the choke.

Another object of this invention is to control the amount of the discharged fluid while maintaining good pump efficiency.

Still another object of this invention is to control the amount of the discharged fluid while the product of the discharged pressure and the amount of the discharged fluid is kept constant.

A further object of this invention is to control the amount of fluid which is introduced into an actuator by varying the volume of the pump and varying the opening area of the choke.

An additional object of this invention is to control the amount of fluid being introduced into the actuator more carefully by using an auxiliary choke.

This invention has another object of controlling the actuator smoothly even when the amount of the discharge fluid from the pump becomes minimum.

According to this invention, these objects are achieved by calculating the amount Q of fluid being introduced into the actuator from the opening area S of the channel through which the fluid passes and the pressure difference ΔP in the channel upstream and downstream of the choke, as described by the formula (1).

$$Q=S\cdot\Delta P^{\frac{1}{2}} \quad (1)$$

Therefore, the device of this invention maintains the pressure difference ΔP constant by varying the volume of the pump, and the opening area S of the channel is controlled by the choke which varies the opening area in relation with the pressure of the fluid being introduced into the actuator.

This invention includes a pump, which can vary its volume, a channel through which the discharged fluid from the pump passes towards an actuator, a variable choke which is located in the channel and pressure detecting means which detects the pressure difference across the variable choke. The pump varies its volume in relation with the pressure difference ΔP which is detected by the pressure detecting means. The opening area of the channel is varied by the variable choke in relation to the pressure of the fluid being introduced into the actuator, namely the pressure of the fluid flowing downstream of the variable choke.

The device of this invention may further have an auxiliary variable choke located in the channel. The auxiliary variable choke can control the amount of the fuel being introduced into the actuator by a signal other than the pressure of the fluid. So that the amount Q of the fluid can be controlled more carefully.

The variable choke of this invention may have a bypass passage through which a little of the fluid passes. This bypass passage has the following special advantage. The amount of the discharged fluid becomes smaller when the opening area of the variable choke becomes smaller, because the pump varies its volume in accordance with the signal from the pressure detecting means. It is well known that the pressure of the discharged fluid is varied by the movement of a piston of the pump, and the influence of variations in the discharged pressure becomes serious when the pump is operated at a small volume. In other words, the varying of the discharged pressure influences the actuator, so that the actuator can not operate smoothly. The fluid from the pump of this invention can always flow through the bypass passage in order to reduce the influence of the varying of the discharged pressure.

BRIEF DESCRIPTION OF THE DRAWINGS

These and other objects and advantages of this invention will become more apparent and more readily appreciated from the following detailed description of the presently preferred exemplary embodiments of this invention, taken in conjunction with the accompanying drawings of which.

DESCRIPTION OF THE PRESENTLY PREFERRED EXEMPLARY EMBODIMENTS

Figure 1:
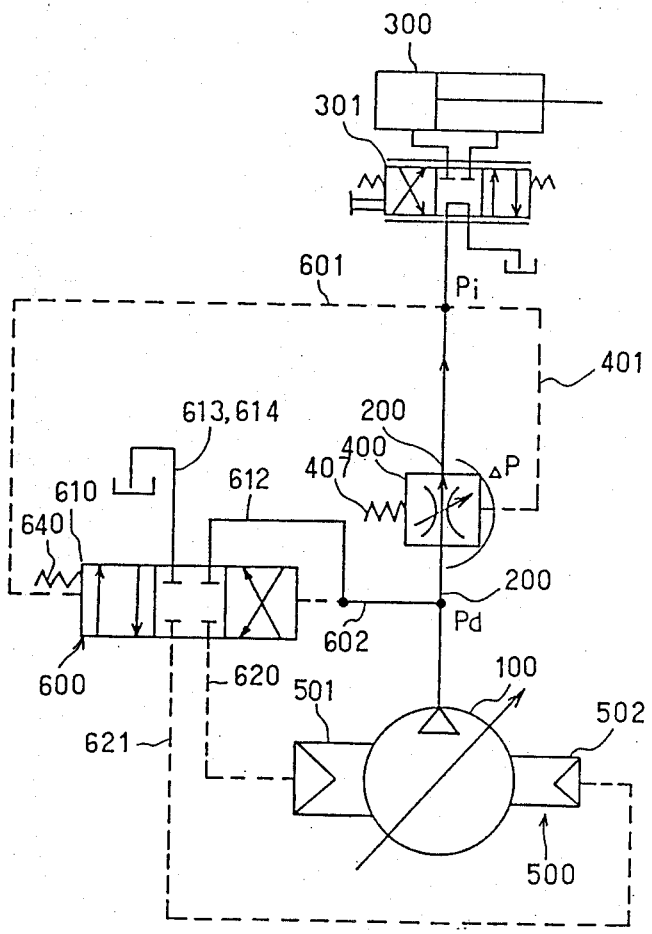
FIG. 1 illustrates an embodiment of the present invention.

In FIG. 1, a pump 100 discharges working fluid through a channel 200 toward a driven actuator 300. Actuator 300 of this embodiment is, for example, a power cylinder of an automotive power steering device. Valve 301 switches the working fluid being introduced into actuator 300.

A variable choke 400 is located in channel 200. Variable choke 400 varies its opening area in accordance with the pressure of the working fluid being introduced into actuator 300, namely the pressure Pi of the fluid downstream of variable choke 400. Controlling passage 401 transmits pressure Pi of the fluid to variable choke 400.

A variable capacity means 500 varies the volume of pump 100 and includes first and second drive pistons 501 and 502. Variable capacity means 500 is controlled by an oil pressure signal from a pressure detecting means 600. When high pressure is introduced into first drive piston 501 and low pressure is introduced into second drive piston 502, variable capacity means 500 varies the volume of pump 100 in order to increase the pump volume. When low pressure is introduced into first drive piston 501 and high pressure is introduced into second drive piston 502, variable capacity means 500 reduces the pump volume.

Pressures on both the front side and rear side of variable choke 400 are introduced into pressure detecting means 600 via first and second signal passes 601 and 602. Therefore, pressure detecting means 600 detects the pressure difference of the front side and the rear side of variable choke 400.

Figure 2:
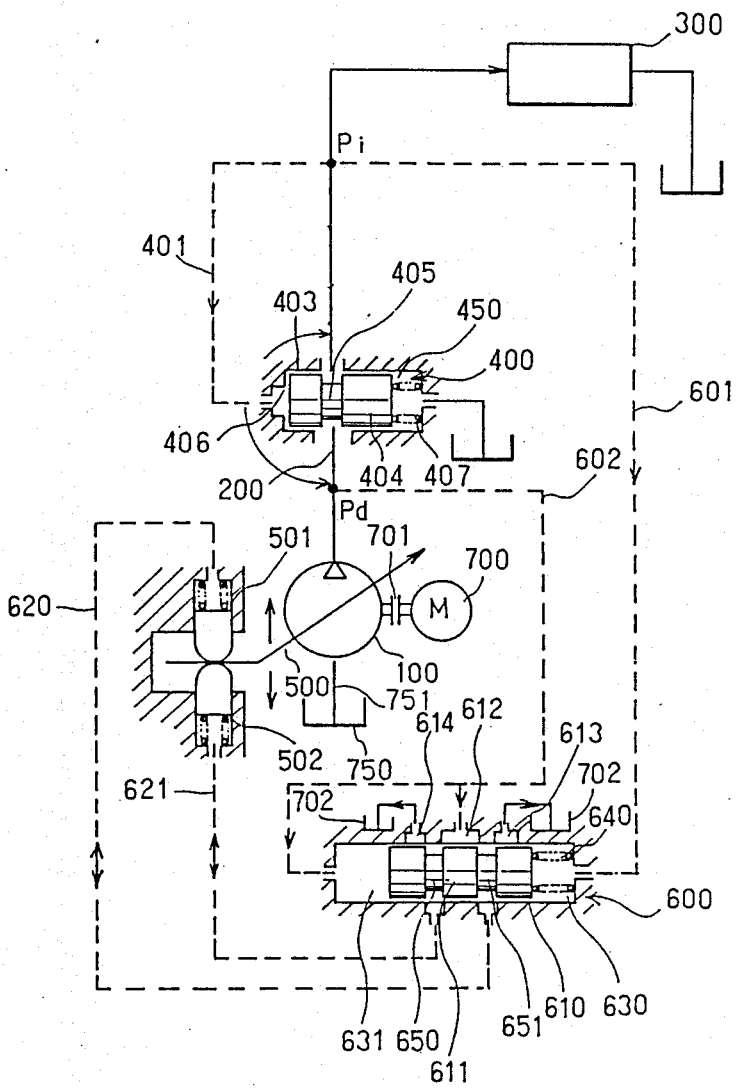
FIG. 2 illustrates in more detail the system shown in FIG. 1.

FIG. 2 shows the device shown in FIG. 1 in slightly more detail. Pump 100 is driven by an automotive engine 700 through a magnetic clutch 701. Pump 100 takes working fluid from a reservoir 750 through a suction pass 751.

Variable choke 400 has a control piston 404 reciprocably disposed in a cylinder 403. Cylinder 403 is provided in channel 200. Control piston 404 has a passing area 405 which faces channel 200, so that the area of passing area 405 facing to channel 200 is varied in accordance with the movement of control piston 404. The opening area of variable choke 400 becomes larger when a sufficient part of passing area 405 faces channel 200. The opening area of variable choke 400 becomes smaller when passing area 405 does not face channel 200 as entirely.

Control piston 404 is reciprocated horizontally as illustrated in FIG. 2 by the pressure difference between the working fluid in a pressure chamber 406 defined by cylinder 403 and the rear edge of control piston 404 and the predetermined pressure of a spring 407 provided at the outer edge of the piston. The pressure Pi of the working fluid downstream of variable choke 400 is introduced into pressure chamber 406 via controlling passage 401. Therefore, control piston 404 moves to the right in FIG. 2 when the pressure Pi exceeds the predetermined pressure of spring 407, so that the opening area of the channel 200 decreases.

Pressure detecting means 600 has a pressure chamber 610 provided in a housing, a switching valve portion 611 provided in pressure chamber 610, an introducing pressure port 612 through which high pressure is introduced into pressure chamber 610, drain ports 613 and 614 through which the pressure in pressure chamber 610 is released, a first pressure passage 620 which connects with first drive piston 501 and a second pressure passage 621 which connects with second drive piston 502. The pressure Pi of the working fluid downstream of variable choke 400 is introduced into a first pressure chamber 630 which is located on the right side of pressure chamber 610 in FIG. 2 via first signal passage 601. The pressure Pd of the working fluid upstream of variable choke 400 is introduced into a second pressure chamber 631 which is located on the left side of pressure chamber 610 in FIG. 2 via second signal passage 602. A spring 640 having a predetermined pressure is located in first pressure chamber 630. Therefore, switching valve portion 611 is reciprocated within pressure chamber 610 by the pressure difference $\Delta P$ between the pressure in first signal passage 601 and that in second signal passage 602 and the predetermined pressure of spring 640. A first and a second connecting area 650 and 651 is provided in switching valve portion 611, so that the switching valve portion can switch between introducing pressure port 612 and first and second pressure passages 620 and 621 and between drain ports 613 and 614 and first and second pressure passages 621 and 622.

Figure 4:
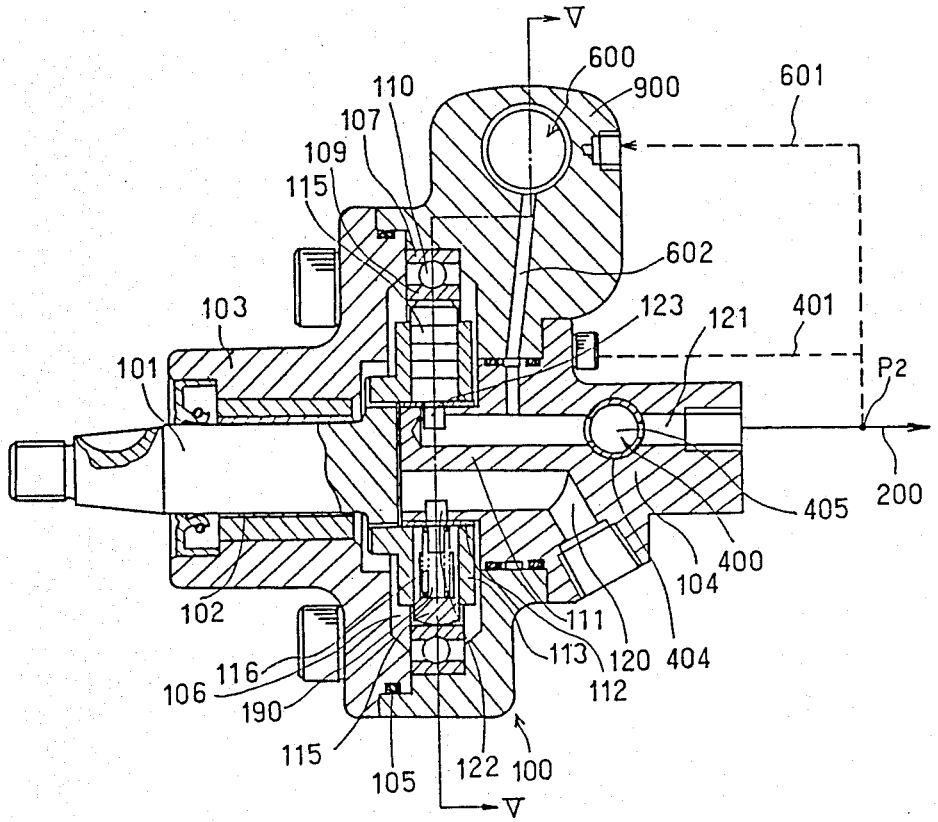
FIG. 4 is a sectional view of the pump.
Figure 5:
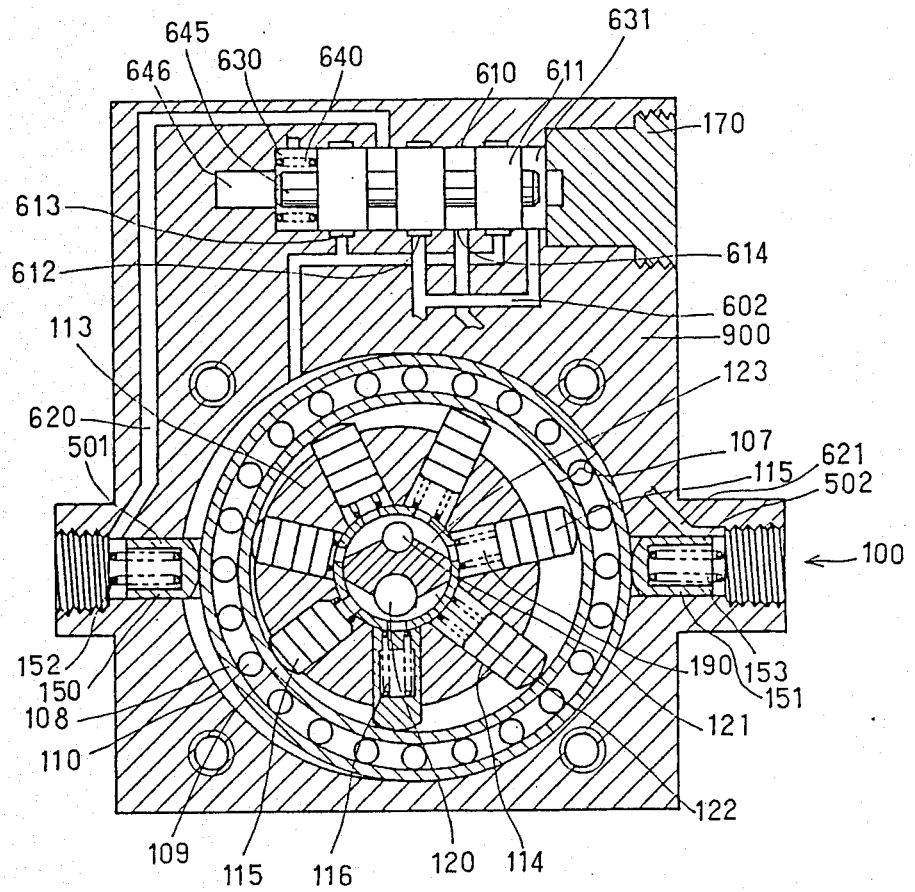
FIG. 5 is a sectional view of the pump taken along the V—V line of FIG. 4.

FIGS. 4 and 5 show pump 100. A shaft 101 is rotated by automotive engine 700 and is supported by a bearing 102 located on a housing 103. A pintle 104 is connected with a main housing 900 via an O ring. A cylindrical working area 106 is defined by main housing 900, pintle 104 and housing 103. A rotary ring 107 is provided in working chamber 106 and includes an outer race 108 which is supported by main housing 900, an inner race 109 and a number of balls 110 which are provided between outer race 108 and inner race 109.

Pintle 104 has a convexing portion 111 which convexes toward working area 106. Convexing portion 111 supports a rotor 113 via a bush 112 in such a manner that rotor 113 can rotate freely. Rotor 113 is rotated with shaft 101. Six cylinders 14 are formed in rotor 113, and are provided with pistons 115 that can reciprocate there within. Springs 116 force pistons 115 outwardly, so that the top edge of pistons 115 always contact inner race 109.

A suction passage 120 and a discharge passage 121 are formed in pintle 104. An edge of each of passages 120 and 121 opens at convexing portion 111 and faces rotor 113. Suction passage 120 reaches rotor 113 at a suction portion thereof via a suction connecting groove 122. Discharge passage 121 reaches rotor 113 at a discharge portion thereof via a discharge connecting groove 123.

A first holding groove 150 which holds first drive piston 501 and a second holding groove 151 which holds second drive piston 502 are formed within main housing 900. Springs 152 and 153, which force first and second drive pistons 501 and 502 toward outer race 108, are provided within first and second holding grooves 150 and 151.

Both first and second pressure passages 620 and 621 are formed within main housing 900, and an edge of each of passages 620 and 621 is connected with first and second holding grooves 150 and 151 respectively. Both first and second holding grooves 150 and 151 are closed at their ends by a screw (not shown), so that closed areas are formed within first and second holding grooves 150 and 151.

Pressure detecting means 600 is provided within main housing 900. Namely, pressure chamber 610 is formed within main housing 900, and switching valve portion 611 is provided within pressure chamber 610. The opening edge of pressure chamber 610 is closed by a screw 170, so that a closing area is formed within pressure chamber 610. Main housing 900 has not only first and second pressure passages 620 and 621, but also introducing pressure port 612 and second signal pass 602 which introduces the signal pressure into second pressure chamber 631. Drain ports 613 and 614 are also formed within main housing 900, the edges of drain ports 613 and 614 are connected with area 106.

Figure 6:
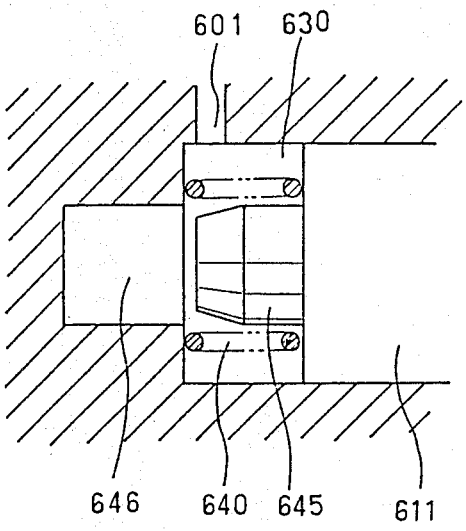
FIG. 6 is a sectional view showing a part of the pressure detecting means.

A convexing portion 645 is formed at the left edge of switching valve portion 611 (as shown in FIG. 6) and is inserted into a groove 646 which is formed in main housing 900. The edge of the convexing portion 645 is tapered, so that working fluid in groove 646 escapes toward first pressure chamber 630 through this tapered portion when convexing portion 645 is inserted into groove 646. Therefore, the flow of working fluid from groove 646 to first pressure chamber 630 is disturbed by a choke formed by the tapered portion and the edge of groove 646, so that switching valve portion 611 cannot be inserted into groove 646 at a fast speed.

Figure 7:
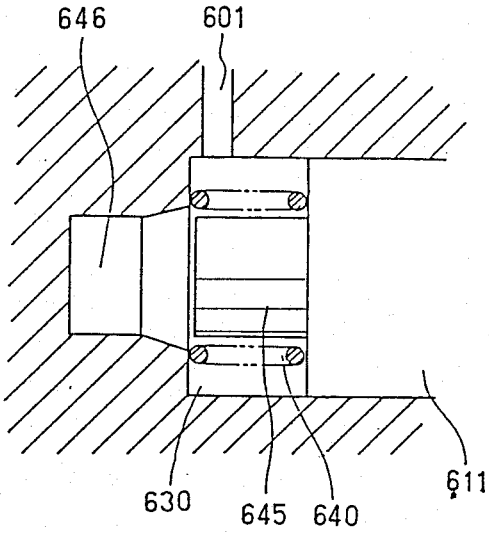
FIG. 7 is a sectional view showing a part of the pressure detecting means of another embodiment.
Figure 8:
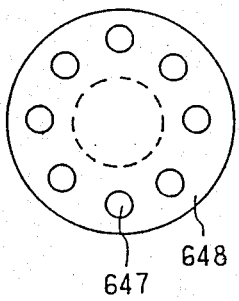
FIG. 8 is a front view of a part of the pressure detecting means of a further embodiment.
Figure 9:
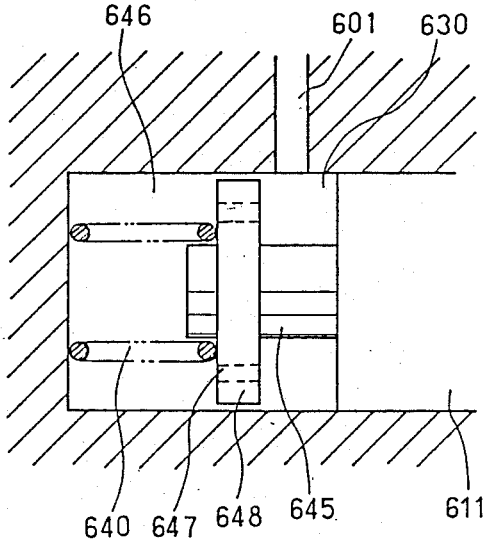
FIG. 9 is a sectional view showing a part of the pressure detecting means using the ring shown in FIG. 8.

Though the tapered portion is formed at the edge of convexing portion 645 (shown in FIG. 6), the taper portion can also be formed at the edge of groove 646 (shown in FIG. 7). Furthermore, a ring 648 having a number of small ports 647 (shown in FIG. 8) can be used instead of the tapered portion. Since working fluid in groove 646 flows toward first pressure chamber 630 through small ports 647 (shown in FIG. 9), switching valve portion 611 cannot move quickly as a result of ring 648. In the embodiment shown in FIG. 9, spring 640 is provided not within first pressure chamber 630 but groove 646.

Variable choke 400 is provided in pintle 104. As shown in FIG. 4, discharge passage 121 formed in pintle 104 is also channel 200, so that variable choke 400 is provided in discharge passage 121. Controlling passage 401 which introduces pressure Pi is also formed in pintle 104.

Figure 3:
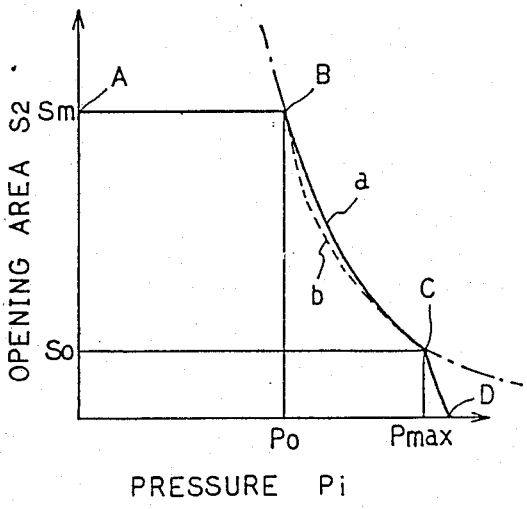
FIG. 3 is a graph showing the character of the variable choke.

The opening area of variable choke 400 is varied in accordance with the pressure Pi, as shown in FIG. 3. While pressure Pi is smaller than the predetermined pressure Po of spring 407, piston 404 is not moved, so that passing area 405 is kept at a maximum area (shown between A-B in FIG. 3). After the pressure becomes larger than the predetermined pressure Po, piston 404 is moved rightwardly in FIG. 2, so that the opening area of passing area 405 becomes smaller (shown between B-C in FIG. 3).

Figure 10:
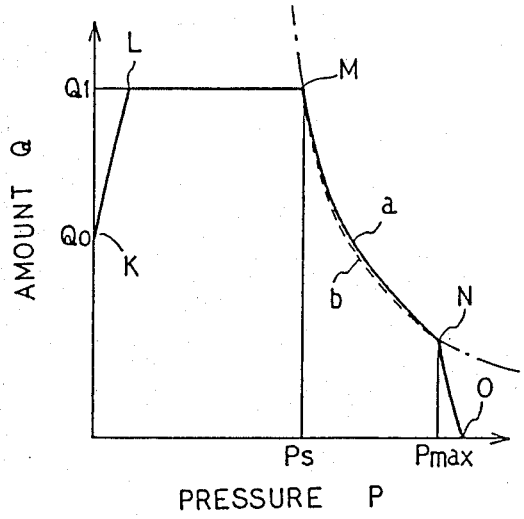
FIG. 10 is a graph showing the relationship between the discharged pressure P and the amount of the discharged fluid Q.

As shown in FIG. 10, the amount of working fluid passing through channel 200 downstream of variable choke 400 is varied in accordance with the opening area of variable choke 400. Although the amount of working fluid increases, in the area between K-L in FIG. 10, this increase is caused not by the variation of the opening area of variable choke 400 but by the starting situation of the pump. When the discharged pressure is rather small, the pressure forcing first and second drive pistons 501 and 502 is smaller than the predetermined pressure of springs 152 and 153. Therefore, rotary ring 107 is moved in order to reduce the volume of pump 100 by the balance of springs 152 and 153. The predetermined pressure of spring 152 is larger than that of spring 153.

The reason why the character shown in FIG. 3 is similar with the character shown in FIG. 10 is described as follows:

As described above, the amount Q of the working fluid passing through variable choke 400 is calculated as the product of the opening area S and the pressure difference P.

$$Q = Cd \cdot S\,((2/\rho)\cdot(Pd - Pi))^{\frac{1}{2}} \qquad (2)$$

Wherein, Cd represents the flow coefficient and p represents the density of the working fluid. Both Cd and $\rho$ are constant. The pressure difference $\Delta P$ is also controlled to be constant by controlling the volume of pump 100. Therefore, formula (2) shows that the amount Q of the working fluid is varied by the opening area S.

The shape of passing area 405 of variable choke 400 is determined in such a manner that the product of the amount Q and the discharged pressure P ($P \times Q$) is always constant, so that the working efficiency of pump 100 is maintained.

Figure 11:
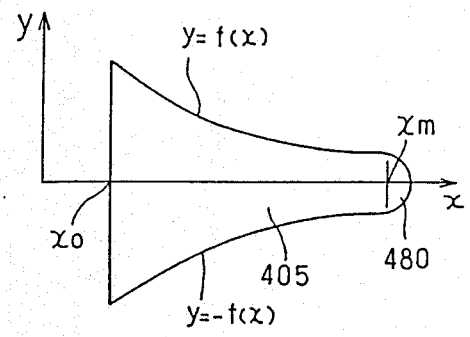
FIG. 11 is a graph of the passing area of the variable choke.

FIG. 11 shows the shape of passing area 405, with the ordinate thereof indicating the moving distance of piston 404. The opening area of passing area 405 is calculated by the following formula if the shape of the passing area 405 is described as $Y = f(x)$.

$$S = \int_{xo}^{xm} 2 \cdot f(x)\,dx \qquad (3)$$

$$= 2\,[f(xm) - f(xo)] + C_3$$

Therefore, the shape of passing area 405 is determined by the condition that the product $P \times Q$ is constant and by formula (3).

As shown in FIG. 11, the edge of passing area 405 is not the shape obtained by formula (3) but a curved shape in order to reduce the opening area of passing area 405 immediately when piston 404 moves the maximum amount. The area between C-D in FIG. 3 and the area between N-O in FIG. 10 show the area related to circular portion 480.

Figure 12:
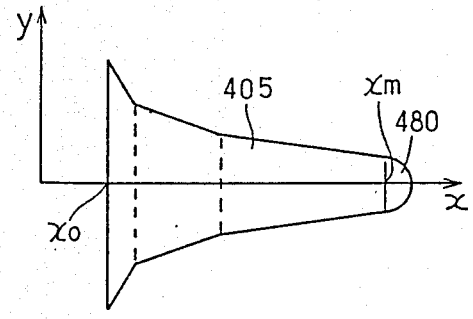
Figure 13:
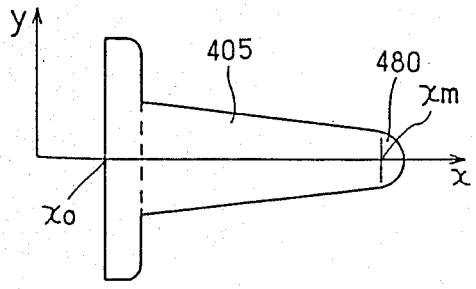

Even though the shape described in FIG. 11 is the best shape for reducing the pump energy, other shapes can be used. FIG. 12 shows another shape which is made from straight lines, so that the shape shown in FIG. 12 is easy to form. Dotted line b in FIGS. 3 and 10 represents the result when passing area 405 is shaped as in FIG. 12. Passing area 405 can be also made by one straight line as shown in FIG. 13.

Figure 14:
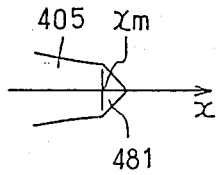
FIGS. 12–15 are graphs of the passing area of other embodiments of the variable choke.
Figure 15:
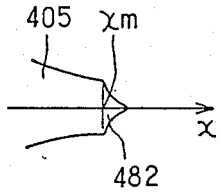
Figure 16:
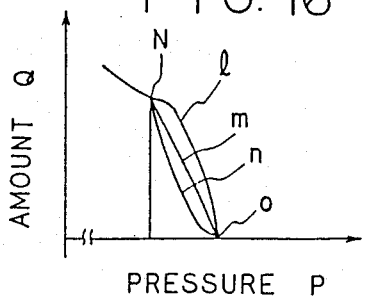
FIG. 16 is a graph showing the character of the variable chokes described in FIGS. 11–15.

The edge of passing area 405 may be the shape shown in FIG. 14 or 15 instead of circular shape 480. Solid line 1 in FIG. 16 shows the result from circular shape 480 in FIGS. 11–13, solid line m shows the result from the shape of edge 481 shown in FIG. 14 and solid line n shows the result from the shape of edge 482 in FIG. 15.

The operation of the device having the structure described above is explained as follows:

Rotor 113 starts to be rotated with shaft 101 when shaft 101 is driven by engine 700. Since the center line of the rotor 113 is eccentric from the center line of the rotary ring 107, pistons 115 are reciprocated within cylinders 114 when rotor 113 is rotated. The stroke of reciprocation of pistons 115 is twice longer than the amount of eccentricity between rotor 113 and rotary ring 107.

While pistons 115 are reciprocated, the volumes of the working chambers 190 defined by pistons 115 and cylinders 114 are varied. While the volumes of working chambers 190 are increasing, the working fluid sucked through suction passage 120 is introduced into working chambers 190 via suction connecting groove 122. When the volumes of working chambers 190 are decreasing, the working fluid in working chambers 190 is discharged toward discharged passage 121 via discharged connecting groove 123.

As described above, the reciprocating stroke of piston 115 is varied in accordance with the amount of eccentricity between rotary ring 107 and rotor 113. Rotary ring 107 is moved horizontally in FIG. 5 in accordance with the movement of first and second drive pistons 501 and 502 which are located at opposite sides of rotary ring 107. When rotary ring 107 moves to the right (shown in FIG. 5) the amount of eccentricity becomes larger, so that the variation of the volume of working chamber 190 becomes larger. Therefore, the capacity of pump 100 also becomes larger. When the rotary ring 107 moves to the left in FIG. 5, the amount of eccentricity becomes smaller, so that the capacity of pump 100 becomes smaller.

The capacity of pump 100 is controlled in such a manner that the pressure difference between the front side and the rear side of variable choke 400 is always constant. The pressure Pi of the working fluid downstream of variable choke 400 is introduced into first pressure chamber 630 via first signal passage 601, and the pressure Pd of the working fluid upstream of variable choke 400 is introduced into second pressure chamber 631 via second signal passage 602. Since first pressure chamber 630 is located at the opposite side of valve 600 from second pressure chamber 631, the pressure difference (Pd−Pi) acts on valve portion 611. Therefore, valve portion 611 is moved by the pressure difference and the predetermined pressure of spring 640.

When the pressure difference is smaller than the predetermined pressure of the spring 640, the switching valve portion 611 is moved to the right in FIG. 5 by spring 640, so that the working fluid discharged from working chamber 190 is supplied to first pressure passage 620 via introducing pressure port 612 and connecting area 651. Therefore, the high discharge pressure is introduced into the back of first drive piston 501. At the same time, the working fluid at the back of second drive piston 502 flows toward connecting area 650 via second pressure passage 621. Then the working fluid returns to working area 106 through drain port 614. Therefore, rotary ring 107 is moved by first drive piston 501 to increase the amount of eccentricity. Accordingly, the capacity of pump 100 becomes larger when the pressure difference is small.

After the discharged amount from pump 100 becomes larger, the pressure difference becomes larger. When the pressure difference becomes larger than the predetermined force of spring 640 switching valve portion 611 is moved to the left in FIG. 5 against spring 640. In this situation, the discharged fluid from working chamber 190 flows toward second pressure pass 621 via introducing pressure port 612 and connecting area 650, so that high pressure is introduced into the back of second drive piston 502. Simultaneously, the fluid at the back of first drive piston 501 escapes toward working area 106 through first pressure pass 620, connecting area 651 and drain port 613. Therefore, rotary ring 107 is moved to reduce the amount of eccentricity. Accordingly, when the pressure difference between the front side and the rear side of variable choke 400 becomes larger, pump 100 reduces its volume.

Pump 100 can control its volume to keep the pressure difference between the front side and the rear side of variable choke 400 constant by repeating the operations described above.

The opening area of variable choke 400 is controlled in accordance with the pressure Pi of the fluid downstream of variable choke 400. Pressure Pi is the pressure of the fluid supplied to power cylinder 300 of the power steering device. When the power steering device needs a large amount of working fluid, such as when the steering is operated, the working fluid need not be at high pressure. When the steering position is not moved, such as when the automobile is driven off-road, the power steering device does not need a large amount of working fluid, but the pressure should be high.

In order words, the character of the working fluid supplied to power cylinder 300 should be that showing in FIG. 10. A large amount of working fluid is needed at normal pressures (the area between L and M in FIG. 10). However, a large amount of working fluid is not needed when the required pressure becomes maximum.

Since variable choke 400 controls the opening area of channel 200 in accordance with the pressure Pi of fluid supplied to power cylinder 300, the device described above can accomplish this type of control. Furthermore, since the volume of pump 100 is controlled to maintain the product of the pressure P and the amount Q (P×Q) constant, the working efficiency of pump 100 can be optimized.

Figure 17:
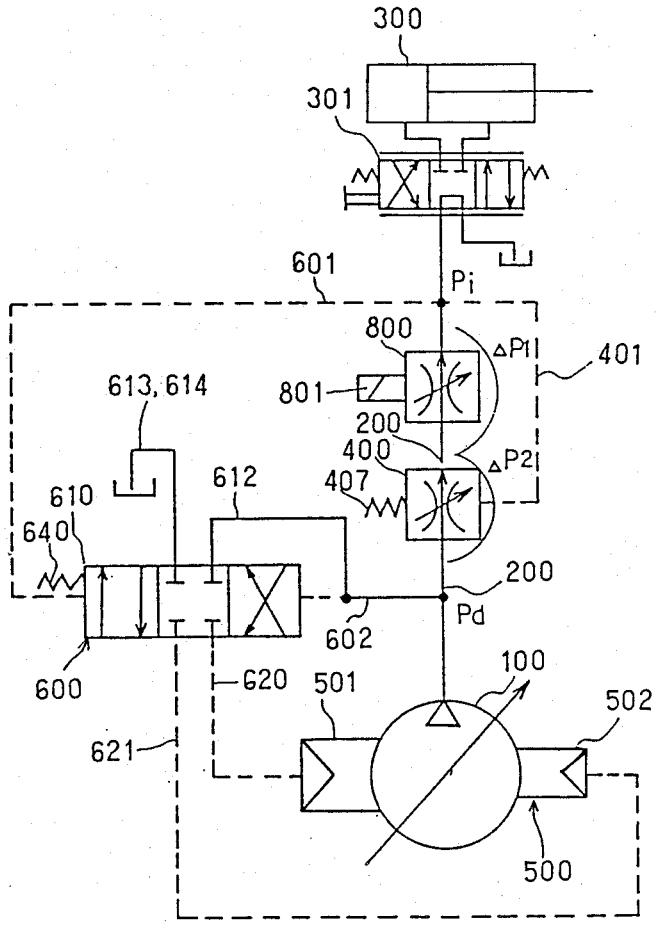
FIG. 17 illustrates another embodiment of the present invention.
Figure 18:
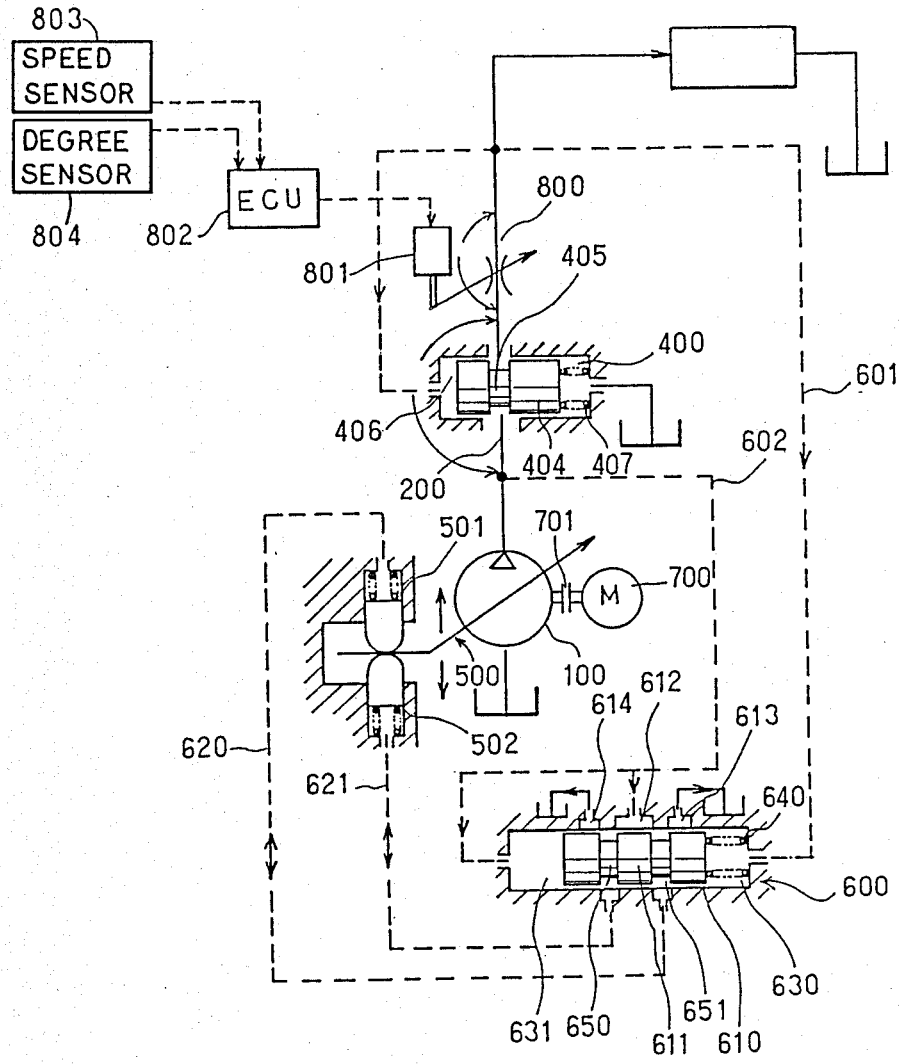
FIG. 18 illustrates in more detail the embodiment shown in FIG. 17.

FIGS. 17 and 18 show another embodiment of the present invention. This embodiment has an auxiliary variable choke 800 in channel 200 downstream of variable choke 400, every other structure of this invention is the same as the embodiment described above. Variable choke 400 is controlled by the pressure Pi of fluid downstream of auxiliary variable choke 800 via controlling passage 401. Pressure detecting means 600 detects the difference between the pressure Pi of fluid downstream of auxiliary variable choke 800 and pressure Pd of fluid upstream of variable choke 400.

Therefore, in the device of this embodiment, the volume of pump 100 is controlled to maintain constant the pressure difference between the front side of variable choke 400 and the rear side of auxiliary variable choke 800, and variable choke 400 is controlled in such a manner that the product of pressure P and the amount Q of the discharged working fluid is maintained constant.

Since this embodiment employs auxiliary variable choke 800, the amount of working fluid supplied to power cylinder 300 is controlled more carefully. The opening area auxiliary variable choke 800 is controlled by an electric solenoid 801, and electric solenoid 801 is controlled by the electric signal from a controller 802. Controller 802 calculates the required amount of working fluid to be supplied to power cylinder 300 from the signals from a speed sensor 803 and a sensor 804 detecting the degree of the steering, and then supplies the electric signal to electromagnetic solenoid 801 in order to control the opening amount of auxiliary variable choke 800.

Figure 19:
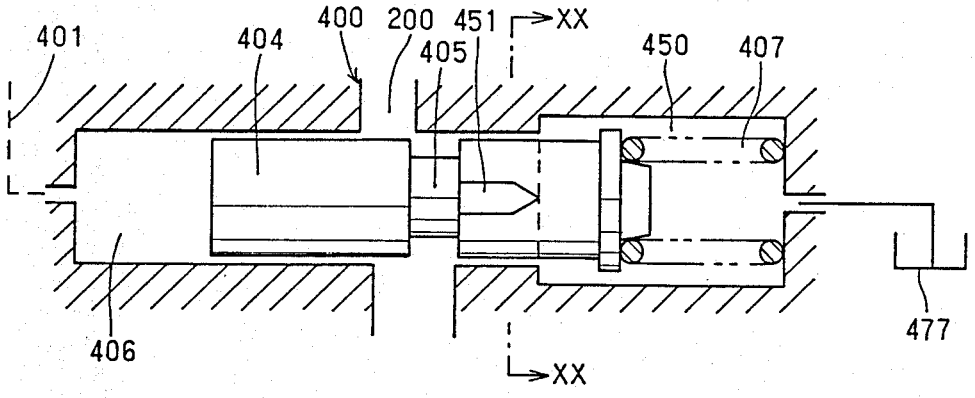
FIG. 19 is a sectional view of the variable choke of the other embodiment.
Figure 20:
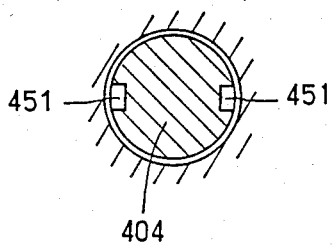
FIG. 20 is a sectional view of the variable choke taken along the XX—XX line of FIG. 19.

FIGS. 19 and 20 show variable choke 400 of another embodiment of the present invention. In this embodiment, variable choke 400 has a bypass passage 451 which interconnects a drain chamber 450 and passing area 405. The other structure of this embodiment is the same as previous described.

Since pump 100 controls the amount of working fluid discharged in accordance with the requirement of power cylinder 300, the required amount of discharged working fluid becomes nearly zero when the required pressure of the discharged working fluid becomes maximum. The pressure of the discharged working fluid, however, is varied in accordance with the operation of working chamber 190. This variation of the discharge pressure does not cause serious influence when the amount of discharged working fluid is large enough. However, the influence of this variation of the discharged pressure becomes serious when the amount of the discharged working fluid is not large enough.

In order to solve the problem described above, the device of this embodiment employs bypass passage 401 so that the working fluid in passing passage 405 can escape toward drain chamber 450 even when passing passage 405 closes channel 200. In other words, the device of this embodiment ensures a minimum flow of discharged working fluid from pump 100 by employing bypass passage 451. The working fluid which escapes to drain chamber 450 then flows toward working area 106 within pump 100 or a reserve tank 477.

Figure 21:
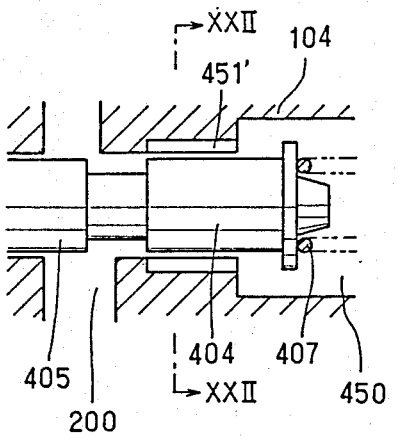
FIG. 21 is a sectional view of the variable choke of a further embodiment.
Figure 22:
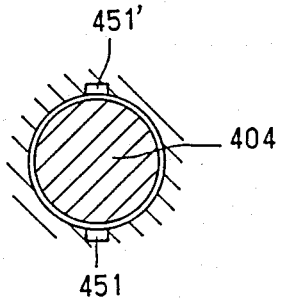
FIG. 22 is a sectional view of the variable choke taken along the XXII—XXII line of FIG. 21.

Bypass passage 451 of this embodiment is provided at an outer surface of control piston 404 as shown in FIG. 20. However, bypass passage 451' may be formed in pintle 104 of pump 100 as shown in FIGS. 21 and 22. Bypass passage 451' shown in FIGS. 21 and 22 is located at a special position of pintle 104 so that the working fluid in passing area 405 can flow toward drain chamber 450 when passing area 405 closes channel 200.

Though the devices of these embodiments described above employ a radial plunger pump as pump 100, any other type of variable capacity pump, can be used with the present invention. Also, an electric motor can be used as the power source driving pump 100 instead of engine 700.

Though pressure detecting means 600 of the embodiments described above detects the pressure through first and second signal passages 601 and 602, pressure detecting means 600 may use an electric signal from a pressure sensor. Furthermore, an electromagnetic solenoid can be used for varying the opening area of variable choke 400 instead of the mechanical structure such as spring 407. It is needless to say that the device of this invention may have many usages other than with a power steering device.

Since the device of this invention detects the actual working fluid supplied to the actuator for controlling the capacity of the pump, special signal passages for the working fluid, other than the main channel supplying the actuator is not required. Therefore, the channelling for the device is not complicated, and the pump of this invention can work very efficiently.

Since the pump of this invention can vary its capacity, its working efficiency can be maximized.

Furthermore, the working fluid supplied to the actuator can be controlled more carefully if the device of this invention employs the auxiliary variable choke.

The influence of the varying of the discharged pressure can be reduced even when the capacity of the pump becomes smaller if the device of this invention employs the bypass passage. Therefore, the actuator can always be controlled smoothly.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined by the following claims.

What is claimed:

1. A volume controlling pumping device comprising:

a pump for compressing and discharging working fluid;

variable choke, having an input connected to an output of said pump and having an outlet;

mechanical means for controlling said variable choke to adjust the fluid flow through said variable choke in direct response to fluid pressure at said outlet of said variable choke and substantially independently of fluid pressure at said input of said variable choke, whereby said variable choke means is controlled substantially independently of vibration of the discharge pressure of said pump; and means for varying the capacity of said pump so as to maintain the fluid pressure difference on opposite sides of said variable choke means constant.

2. A volume controlling pump device comprising:

a pump for compressing and discharging working fluid at an output;

a channel fluidly coupled to said output of said pump;

variable choke means disposed in said channel for varying the flow through cross-section of said channel, said variable choke means reducing the flow through cross-section of said channel when the pressure of the working fluid in said channel downstream of said variable choke means increases, said variable choke means increasing the flow through cross-section of said channel when the pressure of the working fluid in said channel downstream of said variable choke means decreases;

variable capacity means for controlling the capacity of said pump including a first drive piston and a second drive piston; and pressure detecting means for detecting the pressure of working fluid in said channel downstream and upstream of said variable choke, including:

first pressure passage through which a control signal is introduced into said first drive piston, a second pressure passage through which a control signal is introduced into said second drive piston, an introducing pressure port through which pressure of working fluid in said channel between said pump and said variable choke is introduced into said pressure detecting means, a drain port through which working fluid is drained from said pressure detecting means, and switching means for selecting the connection of said first pressure passage, said second pressure passage, said introducing pressure port and said drain port from one of: (1) an increasing position wherein said first pressure passage is connected to said introducing pressure port and said second pressure passage is connected to said drain port for moving said first drive piston and said second drive piston so that the capacity of said pump is increased when said pressure detecting means detects the difference of the pressures of the working fluid in said channel downstream and upstream of said variable choke is smaller than a predetermined pressure, (2) a keeping position wherein said first pressure passage and said second passage are shut off from said introducing pressure port and said drain port for keeping the position of said first drive piston and said second drive piston so that the capacity of said pump is maintained when said pressure detecting means detects the difference of the pressures of the working fluid in said channel downstream and upstream of said variable choke means is about said predetermined pressure, and (3) a reducing position wherein said first pressure passage is connected to said drain port and said second pressure passage is connected to said introducing pressure port for moving said first drive piston and said second drive piston so that the capacity of said pump is reduced when said pressure detecting means detects the difference of the pressure of the working fluid in said channel downstream and upstream of said variable choke is larger than said predetermined pressure.

3. A volume controlling device as in claim 2 wherein said pressure detecting means supplies a signal to said variable capacity means for reducing the capacity of said pump when said pressure difference is higher than a predetermined pressure difference, and supplies a signal to said variable capacity means for increasing the capacity of said pump when said pressure difference is lower than said predetermined pressure difference.

4. A volume controlling device as in claim 2 wherein said pump includes:

a rotary ring;

a rotor provided within said rotary ring in such a manner that the center of said rotor is offset from the center of said rotary ring;

cylinders provided radially within said rotor; and pistons freely reciprocable within said cylinders, said pistons reciprocating in accordance with the rotation of said rotor and the amount of said offset so that the working fluid is compressed and discharged.

5. A volume controlling device as in claim 4 wherein said variable capacity means includes a drive piston provided outside of said rotary ring, said drive piston adjusting the amount the center of said rotary ring is offset from the center of said rotor to vary the capacity of said pump.

6. A volume controlling device as in claim 5 wherein said pressure detecting means supplies a first signal to said drive piston of said variable capacity means for reducing the amount of offset between said rotary ring and said rotor when said pressure difference is higher than a predetermined pressure difference, and supplies a second signal to said drive piston of said variable capacity means for increasing the amount of offset between said rotary ring and said rotor when said pressure difference is lower than said predetermined pressure difference.

7. A volume controlling device as in claim 6 wherein:

said variable capacity means has a first drive piston and a second drive piston provided outside of said rotary ring; and said pressure detecting means includes:

a first pressure passage through which said first signal is introduced to said first drive piston, a second pressure passage through which said second signal is introduced to said second drive piston, an introducing pressure port through which high pressure is introduced into said pressure detecting means, a drain port through which high pressure is drained from said pressure detecting means, and switching valve means for selectively connecting said first pressure passage and said second pressure passage to said introducing pressure port and said drain port to generate said first and second signals.

8. A volume controlling pumping device comprising:

a pump for compressing and discharging working fluid at an output;

a channel fluidly coupled to said output of said pump;

variable choke means disposed in said channel for varying the flow through cross-section of said channel, said variable choke means reducing the flow through cross-section of said channel when the pressure of the working fluid in said channel downstream of said variable choke increases, said variable choke means increasing the flow through cross-section of said channel when the pressure of the working fluid in said channel downstream of said variable choke decreases;

said variable choke means having a control piston reciprocating within said channel, a passing area being defined by said control piston for passing working fluid through said variable choke means, said passing area varying its area facing said channel in accordance with movement of said control piston so that the opening area of said channel is controlled in accordance with the movement of said control piston, a drain chamber, and a bypass passage connecting said drain chamber and said passing area;

variable capacity means for controlling the capacity of said pump including a first drive piston and a second drive piston; and pressure detecting means for detecting the pressure of working fluid in said channel downstream and upstream of said variable choke, means including:

a first pressure passage through which a control signal is introduced into said first drive piston, a second pressure passage through which a control signal is introduced into said second drive piston, an introducing pressure port through which pressure of working fluid in said channel between said pump and said variable choke is introduced into said pressure detecting means, a drain port through which working fluid is drained from said pressure detecting means, and switching means selecting the connection of said first pressure passage, said second pressure passage, said introducing pressure port and said drain port from one of: (1) an increasing position wherein said first pressure passage is connected to said introducing pressure port and said second pressure passage is connected to said drain port for moving said first drive piston and said second drive piston so that the capacity of said pump is increased when said pressure detecting means detects the difference of the pressures of the working fluid in said channel downstream and upstream of said variable choke is smaller than a predetermined pressure, (2) a keeping position wherein said first pressure passage and said second pressure passage are shut off from said introducing pressure port and said drain port for keeping the position of said first drive piston and said second drive piston so that the capacity of said pump is maintained when said pressure detecting means detects the difference of the pressure of the working fluid in said channel downstream and upstream of said variable choke means is about said predetermined pressure, and (3) a reducing position wherein said first pressure passage is connected to said drain port and said second pressure passage is connected to said introducing pressure port for moving said first drive piston and said second drive piston so that the capacity of said pump is reduced when said pressure detecting means detects the difference of the pressure of the working fluid in said channel downstream and upstream of said variable choke is larger than said predetermined pressure.

9. A volume controlling device as in claim 8 wherein said bypass passage of said variable choke causes working fluid in said passing area to escape to said drain chamber when said control piston closes said channel.

10. A volume controlling device as in claim 8 wherein said bypass passage of said variable choke causes working fluid in said passing area to escape to said drain chamber when the area of said passing area facing said channel becomes smaller than a predetermined area.

* * * * *